United States Patent [19]

Koppelman

[11] 3,986,268

[45] Oct. 19, 1976

[54] PROCESS AND APPARATUS FOR SEASONING WOOD

[75] Inventor: Edward Koppelman, Encino, Calif.

[73] Assignee: Drywood Corporation, Encino, Calif.

[22] Filed: Nov. 19, 1974

[21] Appl. No.: 525,049

Related U.S. Application Data

[63] Continuation-in-part of Ser. No. 398,539, Sept. 17, 1973, abandoned.

[30] Foreign Application Priority Data

Sept. 11, 1974 Germany ..... 2443436

[52] U.S. Cl. ..... 34/1; 34/13.8; 34/15

[51] Int. Cl.[2] ..... F26B 3/34; F26B 7/00; F26B 5/04

[58] Field of Search ..... 34/1, 13.4, 13.8, 15

[56] References Cited

UNITED STATES PATENTS

| | | | |
|---|---|---|---|
| 2,373,374 | 4/1945 | Bierwirth | 34/15 X |
| 2,387,595 | 10/1945 | Luth et al. | 34/1 |
| 2,560,763 | 7/1951 | Griffith, Jr. | 34/1 |

*Primary Examiner*—John J. Camby
*Attorney, Agent, or Firm*—Kenyon & Kenyon Reilly Carr & Chapin

[57] ABSTRACT

A process and apparatus for accelerated drying of green lumber employs high voltage dielectric heating at subatmospheric pressure to effect a rapid removal of moisture from the wood without splitting, checking, case hardening, honeycombing or similar damage to the wood structure. The invention combines the advantages of both dielectric and vacuum drying techniques without inefficient and destructive corona, arcing, or ionization effects which have heretofore prevented combining such techniques. When desired, the use of subatmospheric pressures in the drying process also permits injection of suitable chemicals for fireproofing or other specialized treatments of the wood allowing the combination of such treatments with the drying of the wood in a single process.

32 Claims, 7 Drawing Figures

PROCESS AND APPARATUS FOR SEASONING WOOD

CROSS REFERENCE TO RELATED APPLICATION

This application is a Continuation-In-Part application of the inventors' application Ser. No. 398,539, filed Sept. 17, 1973, now abandoned.

BACKGROUND OF THE INVENTION

This invention relates generally to methods and apparatus for seasoning green lumber. More particularly, the invention contemplates a method and apparatus for drying wood at an accelerated rate without damage to the wood structure, which methods and apparatus also permit injection of chemicals for fireproofing or other wood treatments as part of the same process. In addition to the marked reduction in time for drying most woods, the uniformity of drying effected by the methods and apparatus of the invention improves the yield and quality of the seasoned wood produced and permits drying some particularly difficult woods (such as tanoak) which, the industry has heretofore not been able to dry satisfactorily. Also, for reasons that are not yet fully understood, initial experiments with a prototype sized model of the apparatus of the invention indicate that some types of wood can be dried with less total shrinkage than heretofore known.

As is known to those familiar with wood technology, green or freshly cut timber contains large amounts of water, ranging from as low as about 30% by weight to as high as about 900% by weight depending upon the particular species of tree and seasonal conditions at the time of cutting. (The term "by weight" is used throughout this application as referring to the weight of wood in the oven dry condition; i.e. half the weight of a green plank having 100% moisture content is the weight of the water). Some of the water lies in the cell cavities ("free water") and can be extracted without shrinkage. But some of the water is bound within the cell walls ("bound water") and as this moisture is removed, whether naturally or as part of a deliberate drying process, the wood shrinks. To complicate matters, the rate of shrinkage is not uniform, but varies substantially by direction. For example, shrinkage in the tangential direction is typically about twice as great as shrinkage in the radial direction for most woods, and shrinkage in both of these directions perpendicular to the grain is usually much greater than shrinkage along the grain.

The shrinking properties of wood are, of course, the principal reason why wood must be properly dried in advance of its use, since otherwise the wood lacks the dimensional stability necessary for nearly all applications. In addition, wood must be properly dried to prevent decay, to facilitate machining, finishing and gluing, and to improve its strength. Although the final moisture content to which wood must be dried depends upon the dimensional stability, strength and manufacturing processes required for specific applications and in some cases the relative humidity of the geographic region where used, unseasoned boards are generally considered unsuitable for most purposes.

The time required to season green timber properly without damage to the wood has long been a bottleneck in the lumber industry. In spite of the high cost of tying up massive quantities of lumber in inventory during seasoning and the obvious commercial advantages of speeding up the drying process, the industry has heretofore been unable to devise satisfactory methods for accelerating the drying of wood without damage to the wood structure. Typically, green hardwood lumber is first air dried and then further commercial dried employing a kiln drying process which generally requires upwards of six days for most wood species to reduce the water content thereof to within an acceptable range. Typical kiln drying periods for one-inch green lumber to a moisture content of 6% range from about 16 to 28 days for red oak, which is representative of some of the more refractory hardwood species; from about 11 to 15 days for white ash, a common furniture wood; and from about 2 to 7 days for Douglas-fir, which is representative of some of the soft wood species. A simple seasoning of such green lumber by air drying achieved by prolonged storage in a yard requires from about three months to about three years to dry the lumber to a moisture content in equilibrium with the surrounding environment (typically about 14%), depending on environmental conditions and the particular species of wood. Thicker planks and boards require even longer to dry since the drying period typically increases with the square of the thickness.

The principal obstacle to accelerating the drying of wood without damaging the wood structure has been the inability to control excessive and destructive temperature and moisture gradients which are formed in the drying process because of time required to transmit moisture and heat through the wood. Even when wood is air dried at room temperature, the moisture at the surface evaporates first, since, although moisture also evaporates from the surfaces of the internal cells, the high relative humidity within the cells results in a net rate of evaporation which is much slower in the interior of the wood than at the surface. Only as the water vapor in the interior gradually migrates to the surface because of the moisture gradient created in the wood does the interior eventually dry. The difference in moisture content between the surface and interior regions of the wood during the drying process lead to differences in the rate of shrinkage, thereby setting up the internal stresses which lead to splitting, checking, casehardening and similar types of seasoning defects when the stresses are sufficiently severe.

In addition to the extensive times required for present air drying and kiln drying techniques, such techniques result in a significant amount of degradation of the wood. Hardwood lumber is typically air dried to initially reduce the moisture content to a range between 20 and 30 percent before placing it in the kiln. During the air drying process, some of the wood invariably degrades because of its exposure to the elements. In addition to splitting, checking, and similar seasoning defects, this exposure often leads to stain and decay. Consequently, a significant percentage of the lumber (frequently between 5 and 15 percent) is lowered in grade before it even reaches the kiln. The amount of degradation is even worse if the lumber is not properly separated and "stickered" immediately after the log is converted into lumber.

Attempts to accelerate the drying process by external application of heat compound the problem because wood is a poor thermal conductor. The portions of the wood near the surface heat first thereby accelerating the rate of drying near the surface, but increasing the differences in moisture content and drying rate between the surface and the interior.

For this reason, conventional kiln drying techniques are limited in the amount of heat that can be applied without damage to the wood and typically employ steam or other measures to maintain a relative humidity in the surrounding air which opposes and retards the rate of drying at the surface. Elaborate schedules are typically maintained for monitoring temperature and humidity during the drying cycle to avoid developing excessive moisture gradients and destructive internal stresses. Even if necessary to avoid damage, however, use of steam to retard drying is obviously counterproductive and inefficient. Moreover, conventional kiln drying techniques still contemplate drying cycles in terms of days and weeks.

Proposals for use of vacuum drying techniques to speed evaporation and cause low temperature volatilization of moisture have not been found satisfactory. While use of vacuums can keep temperatures low enough to avoid localized charring and combustion of the wood, low temperature volatilization of the water by use of a vacuum is not by itself the answer, because it is the temperature gradients and resulting moisture gradients that lead to destructive internal stresses within the wood. Because wood is a poor thermal conductor, use of a vacuum results in a counterproductive chilling of the interior of the wood since energy is used to volatilize the moisture.

Others have proposed use of dielectric heating methods because of their known ability to supply heat internally throughout the wood to be dried. Unacceptable temperature and moisture gradients in the wood, are still created, however, because although the electric field can supply heat throughout the wood at a uniform rate, the heat is conducted away from the surface at a faster rate than in the interior. If the voltage of the electric field is not kept low, the effect is sufficiently pronounced to lead to internal charring and combustion of the wood.

Consequently, previous proposals for use of dielectric heating techniques in wood drying have typically emphasized the need to keep voltage and power input low (see, for example, Wood, U.S. Pat. No. 3,031,767) which precludes exploiting the full advantages of dielectric heating, and retards the rate of drying. To ease the temperature and moisture gradients formed even with low power dielectric heating, such proposals have also frequently provided that the process be carried out in a conventional kiln so that hot air with a maintained humidity can be circulated around the wood during the dielectric drying. Maintaining the humidity in the surrounding air is, of course, counterproductive and inefficient for the same reasons as explained in connection with conventional kiln drying. Moreover, the need to circulate hot air requires that the lumber be laboriously separated and "stickered" as in conventional kiln drying, thereby sacrificing one of the important advantages which would otherwise arise from the internal heating characteristics of dielectric heating.

Still others have experimented with heating wood internally by microwave systems, but such efforts have encountered the same problems as previously encountered with dielectric heating, as well as additional complications such as those arising from standing waves. To avoid destructive temperature gradients and internal charring of the wood, as well as damage to the generator from reflected waves, proposals for microwave drying have typically required that boards be individually dried, usually while in motion, with the radiation impinging at a suitable angle to avoid problems created by reflection. While carefully controlled procedures of this type might be useful for limited and expensive specialty applications, they are wholly unsuitable for seasoning large commercial sized loads or green lumber. Alternatively, other microwave proposals have attempted to avoid excessive temperature and moisture gradients by resorting to inefficient and counterproductive measures, such as circulating moist hot air to oppose and retard the drying operation at the surface in the same manner as conventional kiln drying techniques and previous proposals for dielectric heating.

Proposals to limit the temperature developed by dielectric heating methods by applying subatmospheric pressure have also been unsuccessful. While the internal heating effect of dielectric methods might, in theory, be carefully adjusted to compensate for the internal chilling effect of vacuum drying methods, such combination by no means ensures the uniformity of drying necessary to avoid destructive temperature and moisture gradients. By itself the application of a vacuum to dielectric heating methods serves only to limit the maximum temperature developed by lowering the temperature of volatilization, and while it is of course necessary to limit temperatures below charring levels, the principal obstacle to the development of satisfactory methods for rapid drying of wood has been the inability to limit moisture and temperature gradients, not maximum temperature. By in large the art has failed to appreciate this distinction. For example, previous proposals for dielectric drying of odd shaped specialty wood items at subatmospheric pressure fail to make any provision for uniformity in the dielectric heating. With the electric field entering the wood in various directions and concentrations the rate of heating is not uniform, and the principal advantage of dielectric heating is lost. Moreover, with specialty wood objects of varying thickness the varying distance from interior regions to the surface results in differences in temperature and moisture gradients in different directions which compound the internal stresses within the wood.

Proposals which might have effected a uniform dielectric field within the wood at subatmospheric pressure, such as by contacting a closely packed stack of lumber between parallel electrodes, have been discarded because the moisture being extracted from the wood and the high relative humidity of the surrounding reduced pressure atmosphere lead to arcing and ionization effects which cause charring of the wood. Moreover, the charred portions tend to be repeatedly attacked by successive arcs, quickly growing into a low resistance path through the wood which not only distorts the uniformity of the field, but physically damages the entire load.

Some apparently untried proposals for dielectric field heating at subatmospheric pressures have failed to recognize the arcing or ionization problem at all, and needless to say, such proposals have not been practiced satisfactorily. Others have attempted to solve the arcing problem by limiting the process to small applications with low voltage and power levels and spacing the electrodes away from the wood. The voltages employed, however, are not satisfactory for accelerated drying of commercial sized loads of lumber. Moreover, even at the limited voltages used, the spacing of the electrodes away from the wood merely results in energy wasting ionization of the gases between the electrodes and the wood causing glow discharges instead of arcs, rendering the process highly inefficient and wholly unsuitable for large scale commercial application.

In discarding previous proposals to combine dielectric and vacuum drying methods, the industry has been forced to abandon the advantages of both, since for reasons explained above, neither technique can be used satisfactorily by itself. Not only has this failure prevented the industry from progressing beyond the time consuming and expensive kiln drying techniques by which most lumber continues to be seasoned today, but it has also necessitated that fireproofing and other wood treatment be performed by separate and costly processes.

Presently, chemical wood treatments designed to enhance resistance to environmental deterioration and flame retardency are accomplished only after the lumber is partially or completely seasoned. In some cases, the application of such preservative and flame retardant agents is accomplished by first forming a solution containing a desired quantity of the material which is applied to the surface of finished lumber in a manner so as to effect an impregnation and/or coating of the outer stratum thereof. At best, the depth of impregnation from such surface applications of additive solutions is minimal necessitating that the lumber be completely processed through conventional sawmill operations before the application of such agents is performed to avoid a removal of the protective coating during subsequent milling operations. Such surface treatments of lumber invariably leave a substantially untreated core which is susceptible to deterioration when exposed to adverse climatic conditions and is susceptible to burning at the normal untreated rate once a penetration of the protective outer layer has been effected.

To overcome the foregoing problems, it has been proposed to impregnate lumber with such protective agents by applying them under pressure while confined within a suitable pressure vessel or autoclave. This technique, while providing for increased penetration of the agents is extremely time consuming and costly and has not received widespread acceptance. Previous techniques have also frequently required expensive incising procedures (cutting slots in the surfaces of the wood) to achieve sufficient chemical penetration.

By providing the first practical and successful combination of vacuum and dielectric heating techniques, the present invention permits fireproofing and other types of preservative chemicals to be impregnated deeply into the wood during the drying process without the need for separate equipment, incising, or expensive high pressure processes.

SUMMARY OF THE INVENTION

The benefits and advantages of the present invention are achieved by a process and an apparatus in which green or partially-dried lumber, intermediate cuttings or other wood products and residuals are heated in a high voltage electric field while under a subatmospheric pressure which rapidly extracts the moisture at a rate which prevents the development of excessive moisture and temperature gradients which would otherwise rupture the wood structure at the drying rates effected. The electric field is kept substantially uniform by placing the loads of timber between parallel plates which are provided with a thin dielectric coating. This coating serves both to compensate for irregularities in field strength along the surface of the electrode and to prevent discharge of the field by arcing and ionization effects which would otherwise preclude the high voltages employed.

More specifically, in its process aspects, the present invention consists of the steps of placing the green or partially dried wood in an enclosed space which thereafter is evacuated so as to impose a subatmospheric pressure on the wood from as low as about 500 mm Hg to as slow as about 15 mm Hg (millimeters mercury) absolute. The strength of the vacuum employed will vary during the course of a drying cycle in order to optimize the removal of moisture and other volatiles without exceeding a temperature which would cause physical damage to the internal wood structure. Above 500 mm Hg, however, volatilization temperatures exceed 200° F which can lead to deterioration of the cell wall structure. A heating of the water and other volatile constituents entrapped within the internal wood structure is effected by dielectric heating. The application of vacuum and the heating of the wood can be performed simultaneously and continuously although it is also contemplated that the heating can be intermittent and controlled in magnitude so as to replenish the latent heat required for the vaporization of volatiles, while simultaneously avoiding excessive temperatures which are harmful to the wood fibers and preventing a build up of excessive pressures within the internal wood structure. In addition, at the strong vacuums preferably employed for most types of woods, some of the moisture is extracted without volatilization which, by saving the energy necessary for volatilization, results in increased efficiency in the drying operation.

When desired, the drying process can be interrupted to inject flame retardant or preservative chemicals while the wood remains under subatmospheric pressure, the chemicals are absorbed into the cellular structure of the wood. This feature of the invention permits specialized treatment of the wood at minimal added cost over that of the drying operation and at far less cost than conventional high pressure autoclave techniques. Moreover, chemicals can be impregnated to a satisfactory depth without expensive incising procedures.

In its apparatus aspects, the present invention contemplates the use of a rigid three-dimensional enclosure within which the lumber to be dried is loaded and the enclosure is subsequently sealed to permit an evacuation of the gaseous substances therein. The enclosure further contains a movable electrode which is positionable relative to the green lumber and a supporting electrode on which the lumber is placed, between which a dielectric heating of the lumber is effected to cause a liberation and extraction of the moisture and other volatile constituents. The electrodes are provided with a thin film of dielectric substance, such as a polyethylene coating, which maintains the uniformity of the field strength and prevents discharge of the field by arcing and other ionization effects during the drying operation.

An alternative embodiment of the apparatus permits application of compressive forces on the surfaces of the wood while simultaneously subjecting the cellular wood structure to subatmospheric pressure during the drying operation. This embodiment is particularly suitable for difficult to dry woods, which, either because of high density, very high moisture content, or excessive amounts of reaction wood or structural irregularities, tend to warp or twist in spite of uniform heating by the electric field.

Additional benefits and advantages of the present invention will become apparent upon reading of the description of the preferred embodiment taken in conjunction with the accompanying drawings.

DESCRIPTION OF THE PREFERRED EMBODIMENTS

For the purposes of this description and the subjoined claims, the terms "wood" and "lumber" are intended to encompass green or partially-dried timber as originally cut, as well as in any one of the intermediate stages of processing in accordance with usual sawmill practices. Accordingly, these terms emcompass green timber substantially in the as-cut condition; boards, flitches or cants derived from the first cutting of logs; planks which have been ripped to appropriate widths, trimmed planks or boards of appropriate length in addition to usual sawmill waste products, such as chips and bark, for example, which ultimately can be converted into useful products such as chip-board and the like.

Figure 1:
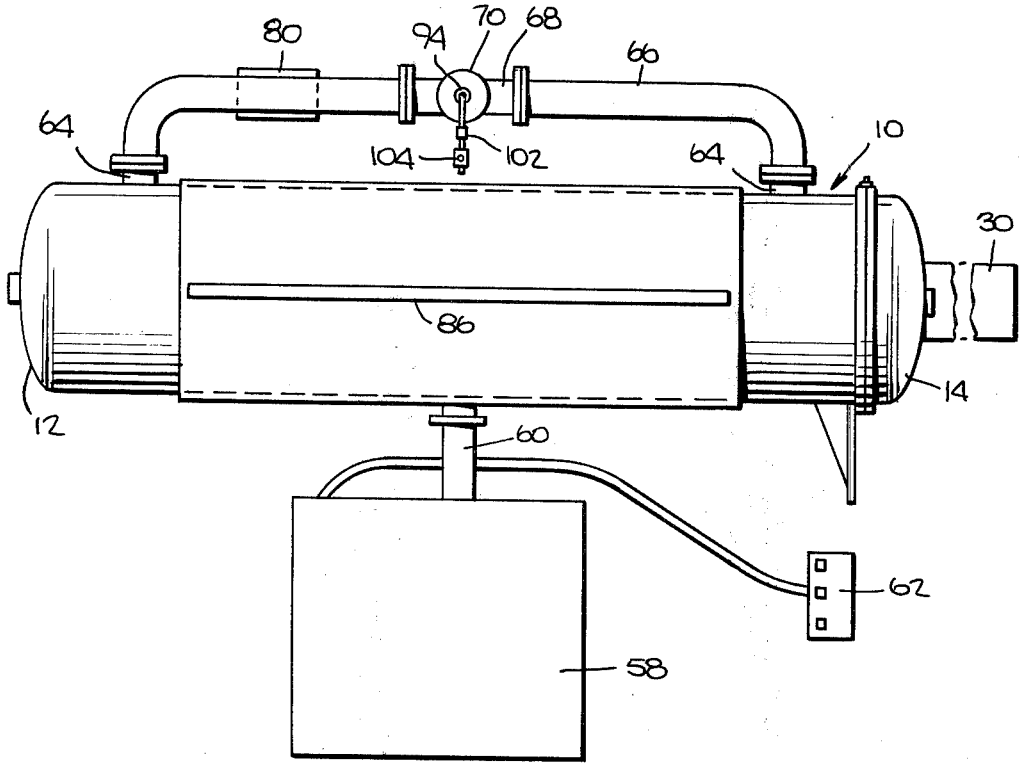
FIG. 1 is a plan view of a vacuum chamber and associated equipment constructed in accordance with a preferred embodiment of the present invention.
Figure 2:
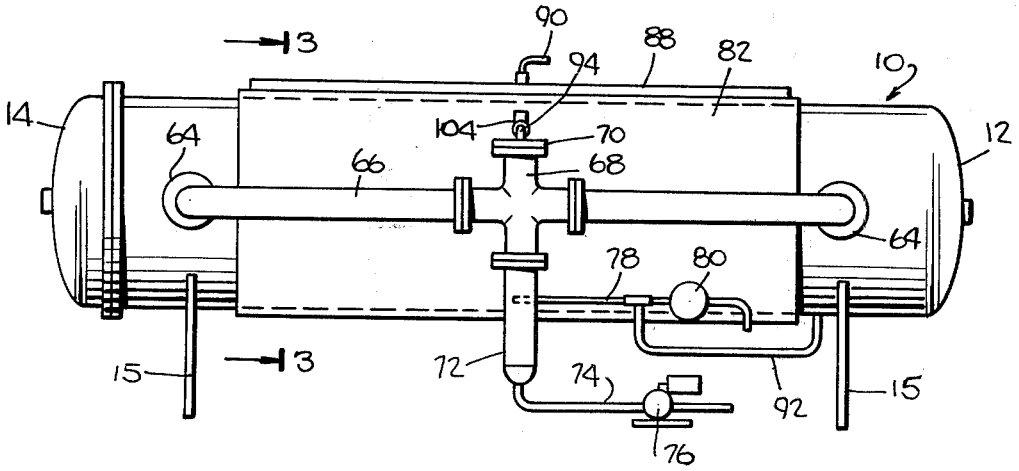
FIG. 2 is a side elevational view of the vacuum chamber and vacuum line as shown in FIG. 1.

Referring now in detail to the drawings, and as may be best seen in FIGS. 1 and 2 thereof, the apparatus for achieving a controlled accelerated drying of green lumber comprises a pressure vessel or tank 10 of a generally circular cross sectional configuration closed at one end by a dish-shaped wall 12 and at the opposite end by a hinged cover member 14. The tank 10 is supported in a substantially horizontal position by means of transverse base members 15 disposed beneath each end portion thereof.

Figure 3:
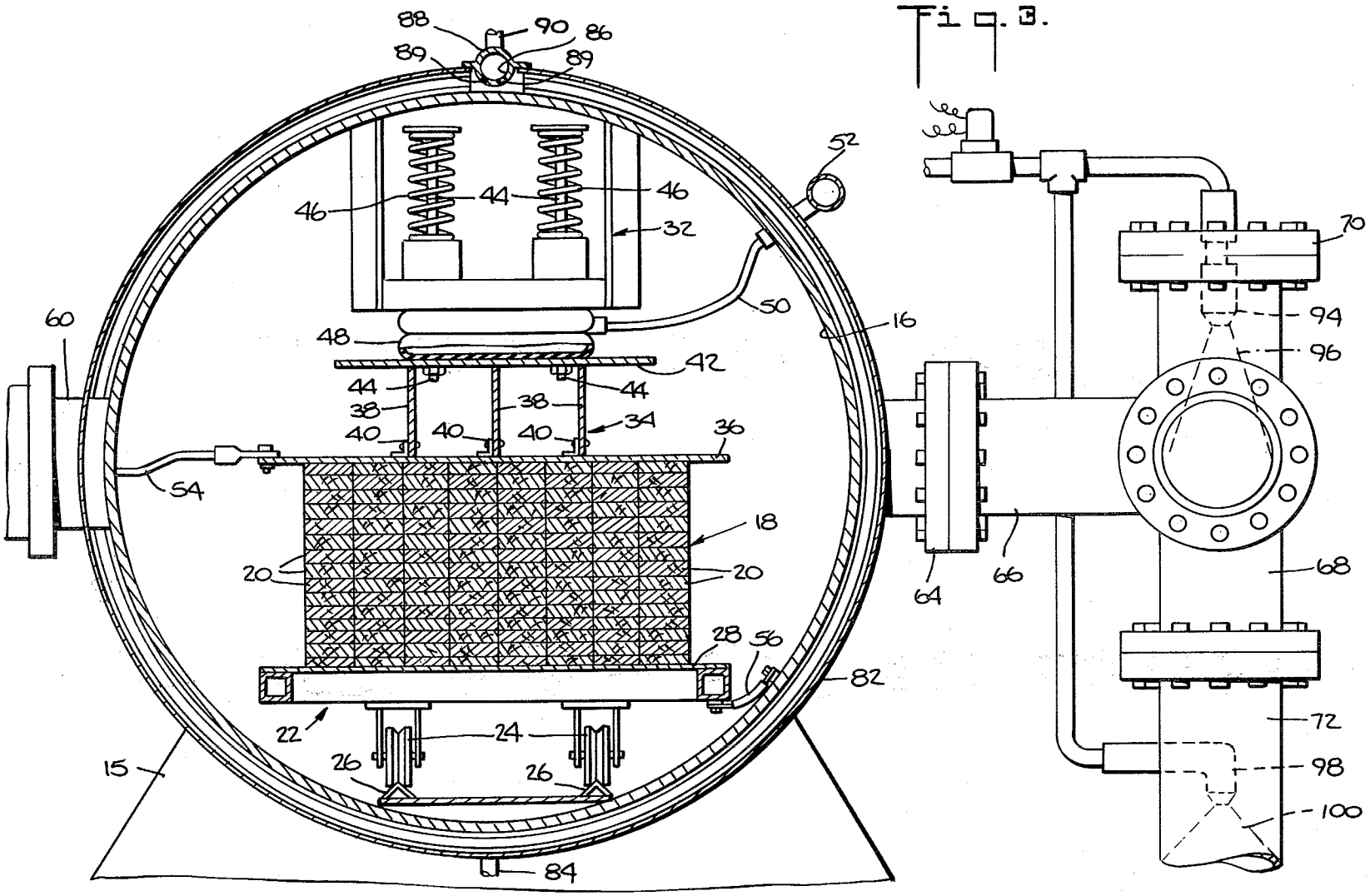
FIG. 3 is a magnified transverse sectional view of the vacuum chamber incorporating a load of green lumber and taken substantially along the line 3—3 of FIG. 2.

The interior of the tank 10 defines an enclosed space or chamber 16 in which a load of stacked green or partially-dried lumber, indicated generally at 18 in FIG. 3, is loaded and retained during the drying cycle. In accordance with a preferred embodiment of the present invention, the planks or boards 20 are stacked directly in longitudinal aligned relationship on the upper surface of a cart 22 which is movably supported by means of grooved wheels 24 on V-shaped rails 26 secured to the bottom wall of the tank 10 as best seen in FIG. 3. The upper surface of the cart 22 is formed with a metallic platform or plate 28 which defines a lower electrode for dielectrically heating the lubmer during the vacuum drying cycle. A suitable framework fragmentarily indicated at 30 in FIG. 1 is positioned outside of the tank 10 and in aligned relationship relative to the rails 26 in the tank to facilitate movement of the cart and a loading and unloading of the drying apparatus at the completion of a drying cycle.

As best seen in FIG. 3, a generally U-shaped framework 32 is secured to and depends from the upper portion of the interior of the tank 10 on which the upper electrode assembly 34 is supported for vertical movement between a lowered position as shown in solid lines in FIG. 3 and a raised position vertically spaced therefrom. The electrode assembly 34 comprises a plate or upper electrode 36 which is substantially coextensive with the lower electrode 28 defining the upper platform of the cart. Three vertical members 38 extend longitudinally of the electrode 36 and are secured by means of angle iron stringers 40 to the upper surface thereof. The upper end portions of the vertical members 38 are securely fastened to a horizontal supporting member 42 which is comprised of an insulating material such as a phenolic resin material. The vertical members 38 similarly are comprised of a reinforced phenolic resin material in order to electrically insulate the upper electrode 36 from the overhead supporting framework 32.

The horizontal member 42 of the electrode assembly is secured at longitudinally spaced intervals along the length thereof to a series of vertically extending rods 44, which are upwardly biased by means of coil springs 46. A corresponding number of inflatable air bags 48 are interposed between the upper surface of the horizontal member 42 and the lower face of the U-shaped framework 32, which, upon inflation, serve to move the electrode assembly downwardly in opposition to the biasing force of the coil springs 46. The supply of a suitable actuating fluid, such as air, to each of the air bags 48 is conveniently achieved by means of flexible hoses 50 connected through the wall of the tank to a supply manifold 52.

In normal operation of the upper electrode assembly, pressure is released from the interior of the air bags 48 to permit the electrode assembly to be raised in clearance relationship relative to a load of lumber in order to facilitate a loading and unloading of the pressure vessel. After the cart and lumber load have been placed in appropriate position, the air bags are pressurized so that the upper electrode moves downwardly either in contact with or in close proximity to the upper surface of the wood load.

The electrodes are provided with a thin film of dielectric substance, such as a polyethylene coating, to maintain the uniformity of the electric field and to prevent arcing and ionization effects. The dielectric coating serves to compensate for surface irregularities in the metal plate around which the lines of force of the electric field tend to concentrate. It is believed that this same effect is instrumental in preventing arcing and other ionization since the regions of high field concentration at surface irregularities along metal electrode plates are typically responsible for arcing and ionization effects because of the extremely high voltages developed in such localized regions, and because of the small gaps having a sharp voltage drop which can be formed at such irregularities. Inasmuch as the invention contemplates use of voltages as high as 6,000 volts during drying of commercial size loads of lumber, the voltages of still higher intensity which can be developed at these surface gaps are more than sufficient to cause repeated arcing if the dielectric coating is omitted.

The upper electrode is conveniently connected to an electric power source, as schematically indicated at 54 in FIG. 3. In order to assure proper grounding of the lower electrode, the cart is preferably connected by a pigtail 56 to the tank structure prior to initiation of the dielectric heating cycle. The generator for the electric power can be conveniently housed in the module 58, as shown in FIG. 1, disposed adjacent to the tank 10, and the power lines connected thereto extend through a conduit 60. The control of the electrically created field heating, as well as the vacuum imposed on the wood during the drying cycle, is regulated by means of a control module 62 as shown in FIG. 1.

The interior of the vacuum chamber 16 is connected to flanged ports 64, which in turn are connected to a suction manifold pipe 66 provided with a flanged cross 68 in the center portion thereof. The upper arm of the flanged cross 68 is provided with a blind flange 70, while the opposite lower end is provided with a downcomer tube 72. The base of the downcomber 72 is connected to a waste line 74, which is connected to the inlet side of a waste pump 76 for pumping out any accumulation of water in the manifold system. A suction line 78 formed with a beveled inlet end projects into the interior of the downcomer at a position intermediate of the ends thereof for withdrawing air and other gaseous products from the suction manifold pipe and the vacuum chamber 16.

The operation of a vacuum pump 80 connected to the suction line 78 is controlled by sensing devices connected to the control system in the control module 62 so as to maintain a vacuum level within the chamber during a drying cycle at the desired magnitude. Once a voltilization and extraction of water commences, the vacuum is at least in part maintained by the subsequent condensation of the water vapors generated and the vacuum pump accordingly is employed for maintaining the vacuum within prescribed ranges.

In order to facilitate a condensation of the water extracted from the wood being dried, at least a portion of the peripheral section of the pressure vessel is provided with an encircling shroud or jacket 82, as best seen in FIGS. 2 and 3, which is formed with a waste or drain line 84 in the bottom thereof. A longitudinally extending slot 86 is formed in the upper section of the shroud in which a distributor pipe 88 is positioned and is connected to a supply of cooling water by means of supply line 90. The distributor pipe 88 is provided with a plurality of angularly extending nozzles 89 for discharging a plurality of streams of cooling water in impinging relationship against the peripheral surface of the exterior of the tank 10 to effect a cooling of the tank and an extraction of the heat liberated by the condensation of extracted moisture on the inner surfaces of the tank. The extracted liquid concentrate formed in the interior of the tank is suitably drained, as shown in FIG. 2, by a drain 92 in the base of the closed end of the tank, which preferably is at a level slightly lower than that of the opposite open end thereof. The drain 92 is connected, as shown in FIG. 2, to the suction line 78 connected to the inlet side of the vacuum pump 80.

Under certain conditions, the quantity of water vapors extracted from the wood being dried may exceed the cooling capacity of the cooling system surrounding the periphery of the tank, whereby the uncondensed water vapors tend to cause a rise in the pressure within the vacuum chamber. To avoid such a pressure rise, a supplemental spray cooling system is embodied in the flanged cross 68, as best seen in FIGS. 2 and 3, to cool and effect a condensation of the vapors entering the inlet of the downcomer. As shown, a first nozzle 92 is mounted centrally of the blind flange 70 and is adapted to discharge a fine spray of cooling water in the form of a conical spray, indicated at 96, into the upper end of the downcomer. A second nozzle 98 is disposed intermediate of the first nozzle and the beveled inlet of the suction line 78 and similarly is adapted to discharge a fine spray of cooling water in the form of a conical spray, indicated at 100, in order to condense any residual water vapors present. The first nozzle and second nozzle are connected by means of a supply line 102, through which pressurized cooling water is delivered when an opening of a remote actuated valve 104 occurs in response to the control module 62.

In accordance with the foregoing arrangement, a typical drying cycle comprises loading a plurality of rough cut green red alder timber comprising 500 board feet on the cart in compact stacked relationship as shown in FIG. 3, obviating the heretofore costly and time consuming practice of stickering the load to provide for a separation of adjoining planks in order to enable an extraction of moisture therefrom. The cart is next moved inwardly of the pressure vessel and the pigtail 56 is connected. The movable end door 14 is closed and the electrode assembly is actuated such that the upper electrode is moved downwardly in close proimity to the upper surface of the load. Thereafter, the vacuum pump 80 is energized, causing a progressive evacuation of the air in the chamber until a vacuum of about 88 mm Hg is attained. At that time, or during the course of the evacuation of the chamber, a dielectric heating of the wood load is achieved by applying a 3 megacycle up to about a 5 megacycle high frequency electric current source across the upper and lower electrodes in a manner to effect an internal heating of the wood load and the water entrapped within the interstices thereof. The initial impressed voltage is 600 volts. The temperature of the load may be suitably monitored by thermal probes (not shown) extending within the interior of the load and the dielectric heating in consideration of the prevailing vacuum is controlled within a temperature range of about 100° F up to about 155° F.

As water vapor is formed and extracted from the wood, cooling water is discharged from the distributor pipe 88 to promote a condensation of the water vapors on the interior surfaces of the tank. The operation of the vacuum pump is controlled so as to supplement the vacuum resulting from the condensation of such gaseous substances to maintain it within prescribed limits. The drying operation is continued until the water content of the lumber charge is within the prescribed limits as may be suitably ascertained by a measurement of the quantity of condensate recovered. Typically, a load of red alder one-inch thick green lumber containing about 98% water by weight when placed in an apparatus as shown in FIGS. 1–3 of the drawings can be satisfactorily seasoned to reduce its water content to a level of about 6–9% at a temperature of about 110° F up to 155° F and at a vacuum of 88 mm Hg in a period of about 3 hours. A drying of a similar green lumber one-inch thick by conventional kiln drying techniques ordinarily requires a period of about 6 to 10 days.

In addition to the substantial reduction in drying times effected by the invention, the uniformity of moisture content in the seasoned wood produced is also improved. This advantage is believed to result from a selective concentration of the dielectric heating in the wetter portions of the wood. Even though the applied field is uniform, the actual energy dissipated in the form of heat is a function of the power factor of the wood (which measures power consumed as a result of dielectric losses) as well as the applied voltage. Although the power factor varies in a complex way with frequency, moisture content, and direction of the applied voltage in relation to the grain, it increases with increasing moisture content for most woods when the voltage is applied perpendicular to the grain. Consequently, more energy is dissipated in the form of heat in the regions having higher moisture content, thereby improving efficiency and uniformity in the drying operation.

The concentration of energy in the wetter portions of the wood is particularly important when the moisture content of the green lumber to be dried is not uniform to begin with. Heretofore, it has typically been necessary to laboriously separate and classify lumber according to its moisture content prior to drying, because conventional kiln drying techniques are carried out with elaborate schedules for monitoring temperature, humidity, and the moisture content of the wood, and if the moisture content of different boards in the load of lumber is markedly different, it is necessary to follow the schedule of the wettest boards, which, of course, is extremely wasteful of time and energy. Moreover, depending upon environmental conditions at the time of cutting, the moisture content within individual green boards or planks may not be uniform. The present invention compensates for this lack of uniformity in initial moisture content. For this reason, although the apparatus of the present invention operates at maximum efficiency with wood having a limited range of initial moisture content, it is unnecessary to separate and classify wood according to initial moisture content.

In addition to the greatly reduced time for drying wood, the process and apparatus of the present invention produces hardwood lumber with substantially less degradation then previous techniques. Because it is unnecessary to air dry hardwood lumber before it is placed in the apparatus of the present invention, the wood is not subjected to the decay, stain, and seasoning defects which heretofore have typically lowered the grade of from 5 to 15% of hardwoods before they reach the kiln. This reduction in degradation of hardwood lumber, results in savings of substantial commercial importance.

With most types of wood, commercial sized loads of lumber are preferably dried at frequencies between 1 and 20 megacycles, most preferably in the range of 3 to 5 megacycles. Frequencies in these ranges further improve the efficiency of the drying operation. This result is believed to arise from the variation of the power factor with frequency and moisture content for most woods. Although the chemical structure of wood and the reasons for the variation in the power factor are complex, empirical evidence suggests that the power factor for wood which contains moisture tends to decrease with increasing frequency to a minimum in the range of 1 to 100 kilocycles, and then to increase to a peak in the range of from 1 to 100 megacycles and then to again decrease with still higher frequencies. For dry wood the effect is much less pronounced, and with some woods appears to be negligible. Since the energy dissipated in the form of heat is a function of the power factor, frequencies in the low kilocycle range (around the minimum for the power factor) are theoretically the least efficient. Frequencies in the low megacycle range are theoretically the most efficient. For commercial sized apparatus, however, frequencies above the low megacycle range, even if nearer the peak in the power factor for a particular type of wood, begin to create standing wave complications which interfere with the uniformity of the drying operation. For reasons which are not fully understood, the frequency range of 3 to 5 megacycles seems to be preferable for the additional reason that a relatively greater proportion of the energy is absorbed by the water than the wood.

Some of the test runs on applicant's prototype apparatus constructed in accordance with the invention indicate that wood can be dried with less shrinkage than heretofore known. This phenomenon is unusually striking, because with the exception of special techniques for drying wood under tension or at sufficiently high temperature to permit creep effects, both of which result in wood having an unstable set, wood shrinkage has generally been considered a function of moisture content, independent of the drying method. Standard tables have been published for average radial and tangential shrinkage of most types of wood as function of moisture content.

Since the chemical mechanism of wood shrinkage is complex, the reasons why some woods should shrink less when dried in the apparatus of the present invention are not fully understood. Much of the bound moisture in wood is thought to be trapped by hydrogen bonding to form cross links between hydroxyl groups along the cellulose chains of the wood structure. As these water molecules are removed, the cellulose chains can close toward each other to form cross links with fewer water molecules or directly between opposing hydroxyl groups, thus resulting in shrinkage. For some types of wood, the accelerated rate of drying may have some effect on this process which results in a reduced amount of shrinkage.

Figure 4:
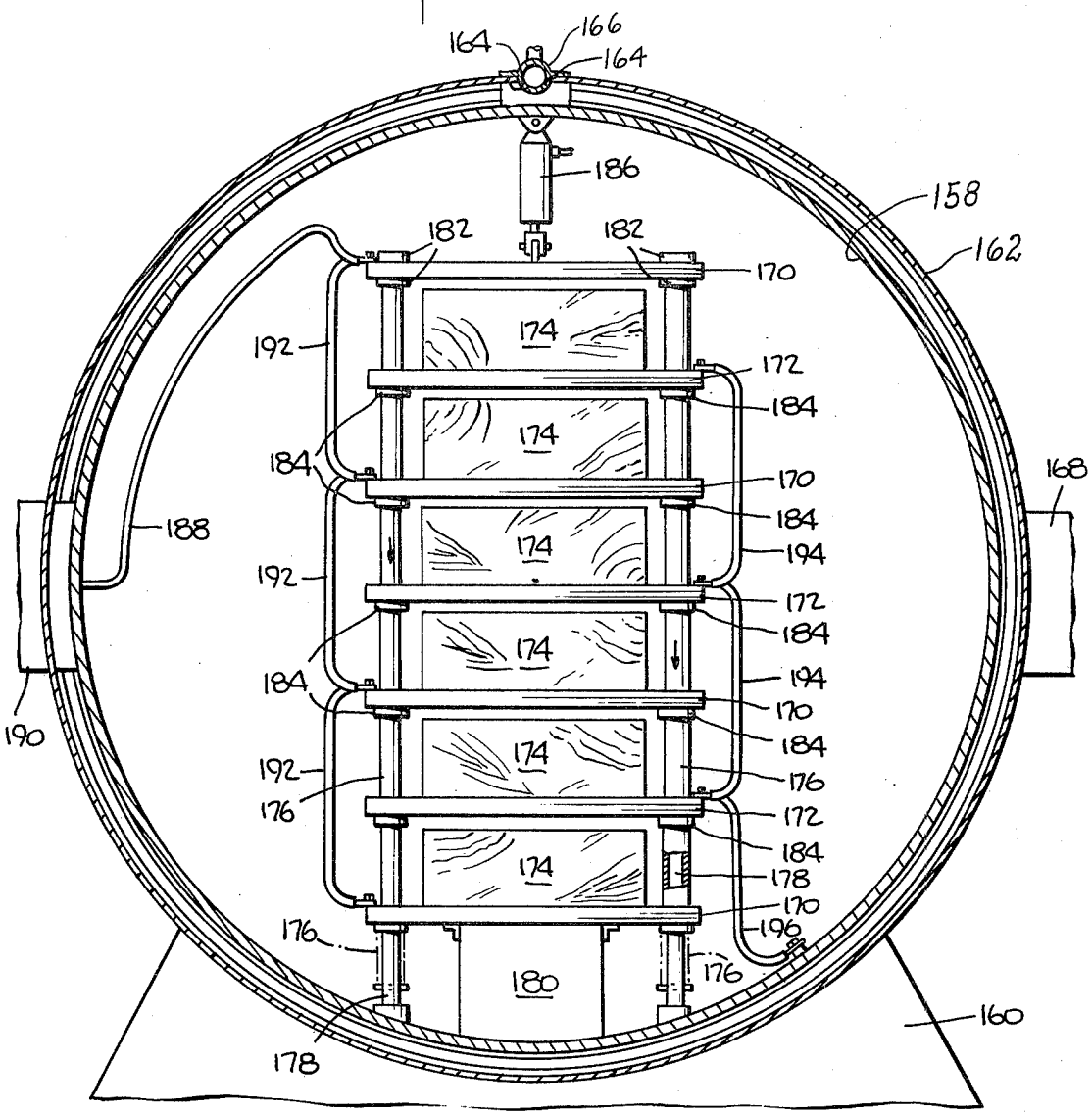
FIG. 4 is a transverse vertical sectional view of an alternative vacuum chamber construction incorporating a plurality of electrodes disposed in superimposed spaced relationship.

Another alternative satisfactory embodiment of a vacuum chamber is illustrated in FIG. 4 which is somewhat similar to the arrangement previously described in connection with FIGS. 1–3 but wherein the chamber incorporates a plurality of electrodes in spaced overlying relationship. As shown, a chamber 158 of a generally circular cylindrical configuration is supported on transverse legs 160 and is enclosed within a cylindrical shroud 162 for confining the water discharged against the periphery thereof through cooling nozzles 164 in a distribution pipe 166 and an appropriate vacuum is drawn in the interior of the chamber through flange ports 168 connected to a manifold system identical to that previously described in connection with FIGS. 1–3. A control of the vacuum and of the temperature to which the wood is heated during the drying cycle is achieved in the same manner as previously described.

The principal distinction between the apparatus shown in FIG. 4 and that shown in FIG. 3 is in the use of a plurality of stacked electrodes of alternating polarity, such as electrodes 170, 172, each defining a shelf within which a relatively large slab of green lumber 174 is positioned. The electrodes are provided with a thin film of dielectric material in the same manner as the electrodes of the apparatus of FIGS. 1–3. The arrangement of FIG. 4 is particularly satisfactory for drying boards or flitches drived from a preliminary cutting operation of green logs, whereafter the resultant dried flitches are subjected to further sawmill operations to cut smaller cross sectional boards enabling the use of substantially thinner blades, thereby reducing waste.

The pairs of stacked electrodes 170, 172 are retained in vertically spaced relationship by means of tubular members 176 which are slidably disposed around upright rods 178 having their lower ends affixed to the inner tank structure. The lowermost electrode 170 is fixedly supported and secured to a pedestal 180 which also is secured to the inner side of the tank structure. The uppermost electrode is securely fastened to the upper ends of the tubular members 176 by a pair of collars 182. The electrodes intermediate the uppermost and lowermost electrodes are slidably supported on the tubular members 176 and are retained in vertically spaced position by means of annular stops 184 secured at spaced intervals to the periphery of the tubular members. A fluid-actuated cylinder or other expandable-contractable device 186 has its closed end affixed to the top of the inner tank structure and the rod end thereof secured to the center of the uppermost electrode for effecting a vertical reciprocation thereof, as well as a reciprocation of the tubular members 176 along the rods 178.

The position of the electrode assembly is illustrated in FIG. 4 with the top electrode and the tubular members in a fully raised position wherein the intermediate electrodes are at a maximum spacing providing for clearance between the slabs of green lumber 174 and the adjacent surfaces of the paired electrodes defining each shelf on which the lumber is received. The clearance thus provided between pairs of electrodes accommodates slight variations in the thickness of the rough cut slabs 174 facilitating a loading and unloading thereof. After the slabs have been loaded between the pairs of electrodes, the fluid-actuated cylinder 186 is actuated causing the uppermost electrode and the tubular members connected thereto to move downwardly to a position as indicated in phantom in FIG. 4 whereby the remaining electrodes move downwardly and become supported against the upper face of the wood slab positioned therebelow. In this way the opposed surfaces of the adjacent electrodes are in close proximity with respect to each piece of wood to be dried.

The supply of electric power to the electrodes is achieved in a manner similar to that previously described in connection with FIG. 3 including a cable 188 passing through a supply conduit 190 which is connected to the uppermost electrode 170 and wherein the remaining electrodes 170 are interconnected by jumper cables 192. The electrodes 172 are interconnected by jumper cables 194 and are grounded by means of ground cable 196 to the tank structure. The actual drying cycle of the wood slabs 174 is performed under conditions identical to those previously described in connection with the apparatus shown in FIGS. 1–3.

Figure 5:
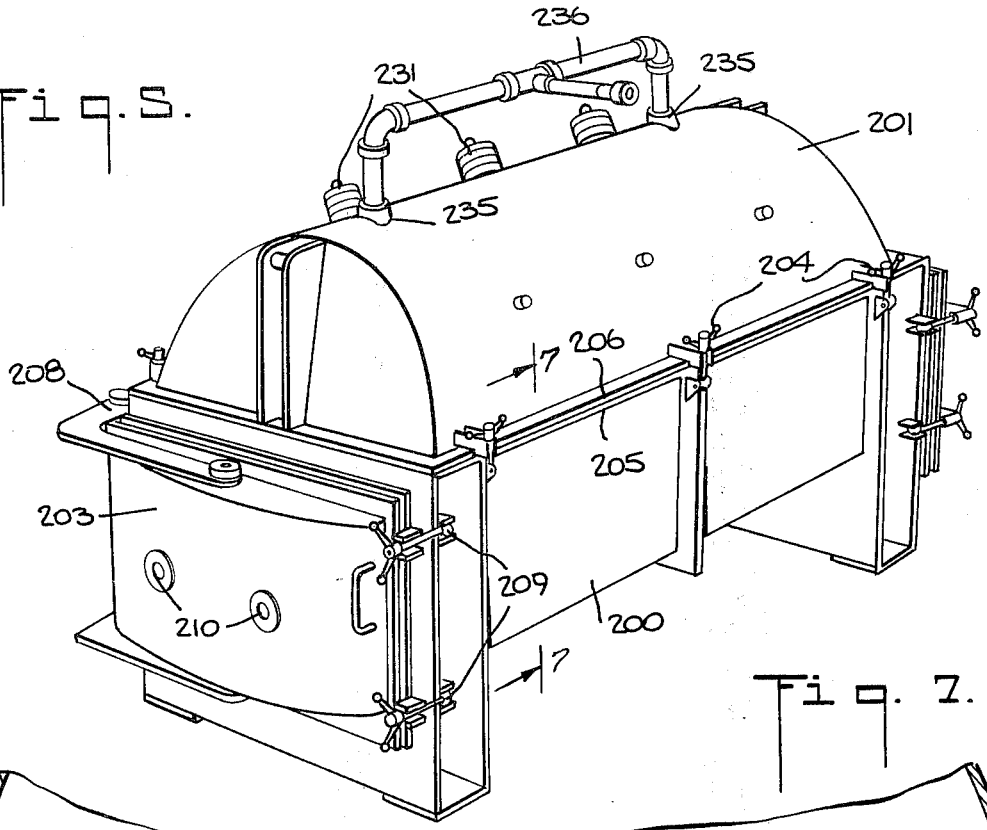
FIG. 5 is a perspective view of an alternative chamber construction which permits applications of high pressure to the wood surfaces during the drying operation, shown with the doors closed and sealed for drying operation.
Figure 7:
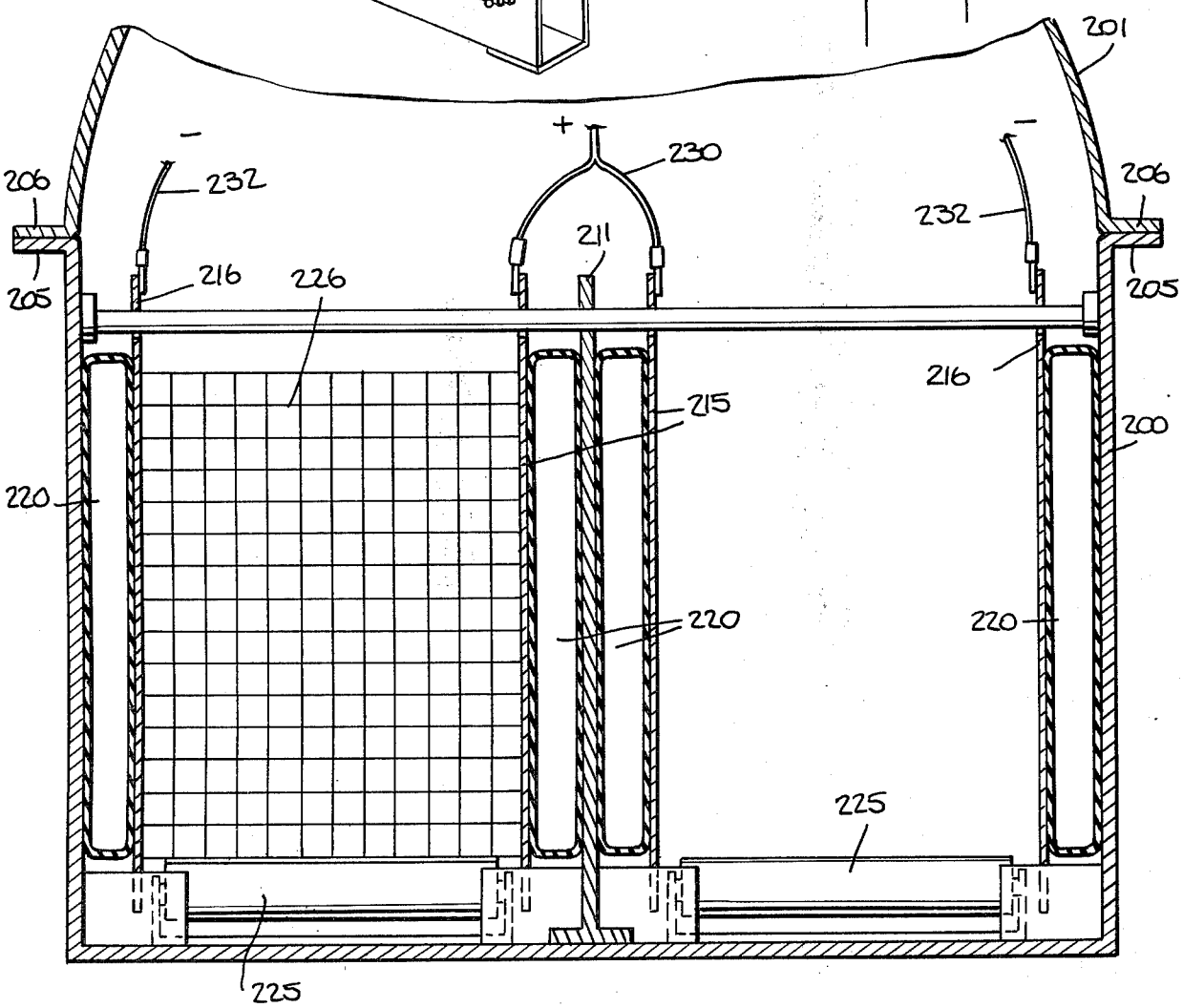
FIG. 7 is a sectional view taken along the lines 7—7 of FIG. 5.
Figure 6:
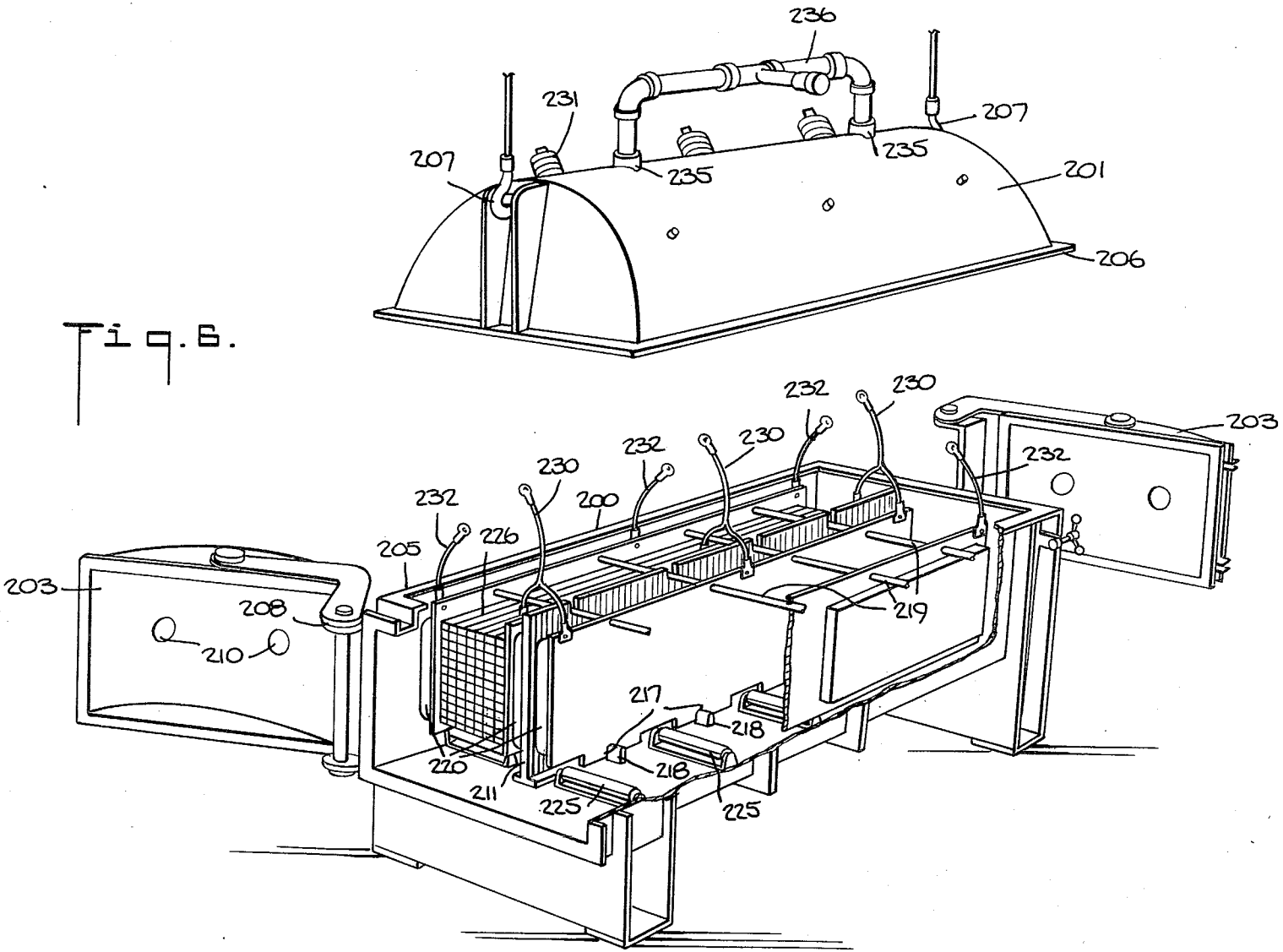
FIG. 6 is a perspective view of the chamber of FIG. 5 shown with top and end open and portions partially broken away.

Another alternative apparatus is illustrated in FIGS. 5–7. This apparatus permits application of compressive forces to the surfaces of the wood during the drying operation to prevent warping or twisting of woods which, because of non-uniformity in density, excessive amounts of reaction wood, or other structural irregularities, are particularly difficult to dry without warping and twisting.

The apparatus comprises a vacuum chamber having a tank of generally U-shaped cross-section, 200, a removable cover of generally rounded cross section, 201, and end doors, 203. When closed for operation, the apparatus appears as shown in FIG. 5.

The cover is secured to the tank by suitable clamps or bolts, such as those shown at 204 around the opposing flanges of the tank and cover, 205 and 206, respectively. During normal operation, the cover remains secured to the tank. For repair, cleaning or other maintenance, access to the inside of the tank can be accomplished by detaching the cover and lifting it by suitable attachment means on the top thereof, such as the hooks shown at 207.

The end doors are shown attached to the tank by suitable hinging means, 208, and are provided with locking means, 209, to seal the vacuum chamber when both doors are closed. Observation ports are provided at 210.

The tank is provided with a fixed center partition, 211, and slideable electrodes. The positive electrodes, 215, are positioned on either side of the center partition. The negative electrodes, 216, are positioned inside the side walls of the U-shaped tank. The electrodes are provided with a thin film of dielectric substance in the same manner as the electrodes in the apparatus discussed above. The electrodes are spaced apart from the floor of the tank and are provided with grooves 217 which ride on fiberglass tongues 218 on the bottom of the tank. The electrodes are also slidably supported at the top by dielectric positioning rods 219, which extend through openings near the top of the electrodes. The electrodes are thus fixed in alignment and vertical and longitudinal position, but are free to slide towards or away from each other.

The apparatus permits application of high pressure to the surfaces of the wood being dried by means of four high pressure air bags, 220, preferably designed to withstand pressures of 50 lbs. per square inch, attached to each of the electrodes. The air bags are secured by fastening means, not shown, to the surface of the electrode opposite the wood, and to the center partition in the case of positive electrodes, and the side walls of the tank in the case of the negative electrodes. The air bags are connected to a separate vacuum and high pressure air system, not shown, which can also be opened to atmosphere.

The bottom of the tank is provided with dielectric rollers, 225, for supporting the lumber to be dried, as shown at 226, in the left side of the chamber in FIGS. 6 and 7.

The positive electrodes are charged by suitable electrical connecting means such as the Y-shapped copper straps shown at 230 which feed through the insulating ports, 231, in the cover. The positive electrodes are also electrically connected at the bottom thereof by copper straps (not shown). The negative electrodes are grounded by suitable electrical connecting means such as the copper straps shown at 232.

Subatmospheric pressure is applied through vacuum ports 235 in the cover. Piping, 236, from the ports is joined to suitable vacuum condenser equipment, not shown.

In operation, the wood is conveyed along conveyor belt systems, not shown, to a position along parallel conveyor belts opposite the end door of the tank. With the end door open, the wood is conveyed by the parallel conveyor belts into the two halves of the chamber along the rollers, 225. When the wood is loaded, the end doors are closed and locked.

The vacuum condenser means is then activated to reduce pressure in the chambers to the desired subatmospheric level. At the same time, the air bags 220, which are connected to the separate air pressure system, are allowed to remain at atmospheric pressure. The difference in pressure between the chamber and the air bags inflates the air bags and pushes the sliding electrodes against the wood. If the wood is of a type which is particularly susceptible to warping, additional pressure can be provided to the air bags to exert additional compressive forces by the electrodes on the sides of the wood. If necessary, an additional air bag (not shown) can be added along the top of the wood attached to a dielectric platen to exert compressive force in a downward direction as well. After the pressure has been reduced to the desired level, the electrical field is activated for the drying operation.

During the drying cycle, the air bags at atmospheric pressure or greater prevent the vacuum within the chamber from resulting in undue force on the side walls of the U-shaped tank except in limited regions not opposite the air bags. This permits the U-shaped tank to be constructed without escessive and expensive bridging or other supports on the outside.

After completion of the drying cycle, the electrical power is turned off and the pressure in the chamber and in the air bags is returned to atmospheric levels. The chamber is them opened at both ends to permit loading the next load of wood to be dried from one end and removal of the seasoned wood from the other end. If necessary, subatmospheric pressure can be applied to the air bags, 220, to pull the electrodes away from the wood. Conveyor belt systems including parallel conveyor belts opposite the end door, not shown, are provided to receive the seasoned wood at the other end.

Although the end doors, 203, are shown as attached by hinging means, it is contemplated that in some applications, particularly where lumber of shorter lengths is to be dried, that the apparatus of FIGS. 5–7 can be provided with sliding or lifting end doors. This construction permits positioning the parallel conveyor belts for feeding the wood closer to the tank.

When desired, fireproofing or other types of preservative chemicals can be injected during the drying cycle before the chamber is returned to atmospheric levels to produce a treated wood product in the same manner as described above.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A process for drying unseasoned wood comprising the steps of placing the wood to be dried in an enclosed space, evacuating the gaseous substances from said enclosed space to impose a subatmospheric pressure on said wood, applying a non-discharging alternating electric potential across the wood between electrodes disposed within the enclosed space and maintained in fixed relationship to the wood while the electric potential is applied to effect a dielectric heating of the wood and the moisture entrapped within the interior thereof until the water content of the wood attains the desired level, and thereafter removing the dried wood from the enclosed space.

2. The process as defined in claim 1 wherein the non-discharging alternating electric potential is applied by positioning the wood to be dried between parallel plate electrodes disposed within the enclosed space and having means for preventing arcing or other sudden discharges, and applying a high frequency electric potential to the electrodes in a manner to effect a dielectric heating of the wood.

3. The process as defined in claim 1 wherein the non-discharging alternating electric potential is applied by positioning wood to be dried while confined in the enclosed space between a pair of electrodes and applying a high frequency electrical potential to the electrodes in a manner so as to effect a dielectric heating of the wood to be dried.

4. The process as defined in claim 1 in which the heating of the wood and the application of subatmospheric pressure to the wood is performed continuously and concurrently.

5. The process as defined in claim 1 in which the heating of the wood and the application of a subatmospheric pressure thereto is performed in an alternating manner.

6. The process as defined in claim 1 in which the temperature of the wood during the drying cycle is controlled so as not to exceed about 200° F.

7. The process as defined in claim 1 in which the temperature of the wood during the drying cycle is controlled so as not to cause plasticization of the wood.

8. The process as defined in claim 1 in which the subatmospheric pressure present during the drying cycle is less than about 500 mm Hg. absolute.

9. The process as defined in claim 1 in which the subatmosphere pressure within the enclosed space is less than about 100 mm Hg. absolute.

10. The process as defined in claim 1 in which the temperature of the wood during the drying cycle is controlled between about 100°F to about 155°F and the pressure is controlled to less than about 500 mm Hg. absolute.

11. The process of claim 1 including the further step of impregnating the wood with fireproofing chemicals by injecting said chemicals into the enclosed space while the wood is under subatmospheric pressure.

12. The process of claim 1 including the further step of impregnating the wood with preservative chemicals by injecting said chemicals into the enclosed space while the wood is under subatmospheric pressure.

13. The process of claim 1 including the further step of applying compressive forces to opposing surfaces of the wood while the wood is under subatmospheric pressure.

14. A process for drying commercial lumber to a moisture content of 12% or less by weight comprising the steps of placing green lumber having a moisture content above 20% by weight in an enclosed space, imposing a subatmospheric pressure on the green lumber for a period between 2 and 24 hours, applying a non-discharing alternating electric potential across the green lumber between electrodes disposed within the enclosed space and maintained in fixed relationship to the green lumber during application of the potential while the green lumber is under subatmospheric pressure and during the period it is at a moisture content between 12% and 20%, and removing the lumber from the enclosed space.

15. The process of claim 14 in which the green lumber has an initial moisture content above 25% by weight.

16. The process of claim 15 in which the green lumber has an initial moisture content above 30% by weight.

17. The process of claim 1 where the green lumber is tanoak.

18. A process for drying commercial lumber to a moisture content of 8% or less by weight comprising the steps of placing green lumber having a moisture content above 20% by weight in an enclosed space, imposing a subatmospheric pressure on the green lumber for a period between 2 and 24 hours, applying a non-discharging alternating electric potential across the green lumber by charging electrodes disposed within the enclosed space and maintained in fixed relationship to the green lumber during application of the potential while the green lumber is between 8% and 20% in moisture content and under subatmospheric pressure, and removing the lumber from the enclosed space.

19. An apparatus for drying unseasoned wood comprising means defining a chamber, means for supporting wood to be dried within said chamber, means in communication with the interior of said chamber for evacuating the gaseous substances therefrom, means disposed within the chamber and adapted to be maintained in fixed relationship to the wood during the drying thereof for applying an alternating electric potential across the wood within the chamber to effect a heating of the interior thereof to the volatilization temperature of the water in the wood at the prevailing subatmospheric pressure present in the chamber, and means for preventing arcing and sudden discharge of the electric potential.

20. The apparatus as defined in claim 19 in which said means for applying an alternating electric potential across the wood comprises a pair of spaced electrodes between which the wood is disposed for applying a dielectric field thereto.

21. The apparatus as defined in claim 20 wherein the means for preventing discharge of the alternating electric potential comprises a coating of dielectric material on the surface of the electrodes.

22. The apparatus as defined in claim 19 in which said means for applying an alternating electric potential across the wood comprises a plurality of electrodes disposed in spaced superimposed relationship and wherein alternate ones of said electrodes are electrically charged with a plurality opposite to that of the adjacent electrodes so as to apply a dielectric field to the wood interposed between adjacent electrodes.

23. The apparatus as defined in claim 22 further including means for moving the electrodes to and from a closed position in close proximity to opposed faces of the wood and an open position disposed in clearance relationship to the wood.

24. The process as defined in claim 1 in which the temperature and the subatmospheric pressure within the enclosed space are sufficiently low that unvaporized moisture is extracted from the wood without damage thereto.

25. The process of claim 1 in which the frequency of the non-discharging alternating electric potential is between 1 and 20 megacycles.

26. The process of claim 1 in which the frequency of the non-discharging alternating electric potential is between 3 and 5 megacycles.

27. The apparatus of claim 21 further including cooling means for condensing moisture on the interior surface of the chamber.

28. The apparatus as defined in claim 21 wherein the spaced electrodes are parallel plate electrodes, each having a substantially planar configuration.

29. The apparatus of claim 28 wherein the parallel plate electrodes are adapted to be positioned adjacent to opposing surfaces of the wood during the heating of the interior thereof.

30. The apparatus of claim 19 wherein the means for applying an alternating electric potential across the wood comprises two pairs of parallel plate electrodes between which wood is disposed, each electrode having a substantially planar configuration, and wherein the means for preventing discharge of the alternating electric potential comprises a coating of dielectric material on the surface of the electrodes.

31. The apparatus of claim 30 wherein the parallel plate electrodes are oriented in vertical planes and adapted to be positioned adjacent to opposing surfaces of the wood during the heating thereof.

32. The apparatus of claim 31 further including flexible bags affixed to the surfaces of the electrodes opposite to the surfaces facing the wood and means in communication with the interior of said bags for supplying air thereto at a pressure above the prevailing subatmospheric pressure in the chamber.

* * * * *